US005349905A

United States Patent [19]

Taylor et al.

[11] Patent Number: 5,349,905

[45] Date of Patent: Sep. 27, 1994

[54] METHOD AND APPARATUS FOR CONTROLLING PEAK POWER REQUIREMENTS OF A PRINTER

[75] Inventors: Thomas N. Taylor, Rochester; Frederick A. Donahue, Walworth, both of N.Y.

[73] Assignee: Xeox Corporation, Stamford, Conn.

[21] Appl. No.: 43,615

[22] Filed: Apr. 5, 1993

Related U.S. Application Data

[63] Continuation of Ser. No. 856,786, Mar. 24, 1992, abandoned.

[51] Int. Cl.[5] ..... B41L 35/14

[52] U.S. Cl. ..... 101/488; 101/424.1; 219/388; 347/102

[58] Field of Search ..... 101/488, 424.1; 400/126; 250/250; 219/216, 388, 469; 346/76 PH

[56] References Cited

U.S. PATENT DOCUMENTS

| | | | |
|---|---|---|---|
| 3,588,445 | 6/1971 | Hopkins . | |
| 4,033,263 | 7/1977 | Richmond | 101/488 |
| 4,460,676 | 7/1984 | Fabel | 400/118 |
| 4,469,026 | 9/1984 | Irwin | 400/126 |
| 4,482,239 | 11/1984 | Hosono et al. | 346/25 |
| 4,547,803 | 10/1985 | Richards . | |
| 4,566,014 | 1/1986 | Paranjpe et al. . | |
| 4,634,262 | 1/1987 | Imaizumi et al. . | |
| 4,719,489 | 1/1988 | Ohkubo et al. . | |
| 4,738,553 | 4/1988 | Uemura et al. | 400/120 |
| 4,970,528 | 11/1990 | Beaufort et al. . | |
| 5,021,805 | 6/1991 | Imaizumi et al. . | |
| 5,189,436 | 2/1993 | Yoshikawa | 400/322 |

OTHER PUBLICATIONS

"Japanese Patent English Abstract", Pat. No. 58-220764; Jun. 18, 1982; Shiegek. Shimizu.

*Primary Examiner*—Edgar S. Burr
*Assistant Examiner*—John S. Hilten
*Attorney, Agent, or Firm*—Oliff & Berridge

[57] ABSTRACT

A thermal ink jet printer incorporates a copy speed feed control for reducing peak power requirements. Printing data supplied to the printer is scanned to determine image density or power consumption to dry ink in a dryer is determined. The speed of the sheet transport system is controlled in accordance with the image density so that, at high image densities, the speed of the sheet at the printer and/or at the dryer is reduced. A controller controls the speed of a drive motor driving the transport system in accordance with a determination of the density of the printed image from image print data or energy required for ink drying. A printer employing on-demand workstations having potentially high peak power usages can be made compatible with conventionally provided power supply systems.

2 Claims, 2 Drawing Sheets

METHOD AND APPARATUS FOR CONTROLLING PEAK POWER REQUIREMENTS OF A PRINTER

This is a continuation of application Ser. No. 07/856,786 filed Mar. 24, 1992, now abandoned.

BACKGROUND OF THE INVENTION

1. Field of the Invention

This invention relates to reducing the peak power requirements of printers, particularly printers having work stations that are powered on an on-demand basis.

2. Description of Related Developments

Many types of reprographic equipment, such as those using electrophotographic reproduction techniques, are in use. Such equipment incorporates work stations that are maintained at predetermined operating power levels. To assure acceptable image quality, a relatively constant speed sheet transport system is used. As a consequence, the power input required by such equipment tends to be relatively constant, after start-up conditions are reached.

Recently, thermal ink jet printing has been developed as an alternative to the fused toner imaging techniques used in electrophotographic and other hard copy imaging equipment. Thermal ink jet printing is basically an on-demand system that requires almost no power at idle conditions but requires high power under high speed, high image density conditions. An advantage of ink jet printing is that image quality does not deteriorate at high throughput rates, in comparison to other methods. The power input excursions in the duty cycle of thermal ink jet printers result from the need to boil the liquid component of the ink (usually water) twice, once in jetting the ink onto the recording medium and a second time in drying the ink and fixing it on the recording medium. To maintain overall power consumption low, it is desirable to use on-demand dryers, such as microwave dryers, that also have widely varying power input requirements governed by copy speed and ink density. For an ink jet printer or marking engine operating at 30 copies per minute, printing with black ink only at a high image density, approximately 2500 watts of power are required. For a 90 copy per minute process color printer, with an high image density, approximately 15,000 watts are required. These power requirements tend to come in bursts, one as the thermal ink jet printer bars are operated and the other as the recording medium passes through the microwave dryer. This results in significant peak power excursions over the duty cycle of the printer. However, from a user acceptability standpoint, it is desirable that normal power lines, such as the 1.5 KVA receptacle terminated lines commonly found in offices and homes, be capable of meeting the power requirements of such printers. This avoids the cost of installing special power lines and allows flexibility in placement of the equipment.

SUMMARY OF THE INVENTION

It is an object of the invention to reduce peak power requirements of printers.

It is a further object of the invention to attenuate peak power requirements of printers employing on-demand workstations, such as thermal ink jet printers.

These and other objects of the invention are achieved by printing apparatus in which the transport speed of the recording medium is inversely correlated to the density of the image printed on the recording medium.

The support member for carrying the recording medium along the feed path of the printing apparatus is driven by a variable speed drive. Input power requirements are anticipated by scanning printing data supplied to the printer to determine the density of the image to be printed or by assessing power levels required for drying ink in a dryer. A control system utilizes the anticipated power requirements to control the speed of the drive so that, for high density images, the speed of the recording medium as it travels past the printer, the dryer or both is reduced in proportion to the density of the image. By control of the residence time of the recording medium in the printing and/or drying stations, peak power requirements at each station can be attenuated and controls simplified.

DESCRIPTION OF PREFERRED EMBODIMENTS

The following description is in the context of a thermal ink jet printer, which serves as a good basis for illustration because it has a duty cycle with widely varying power requirements. However, the invention has applicability in a wide variety of printer designs in which peak power requirements are desirably lessened.

Figure 1:
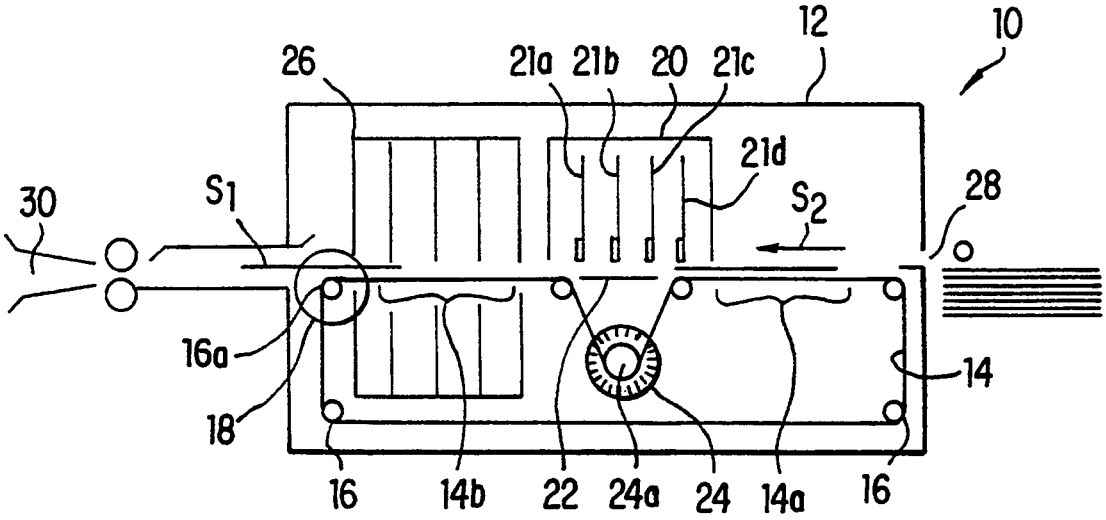
FIG. 1 is a side schematic illustration of a printer embodying the invention.

Referring to FIG. 1, a printing apparatus 10 includes a housing 12 within which is disposed a transport belt 14. Preferably, the belt 14 is foraminous and is associated with a vacuum source (not shown) for causing recording media, such as sheets $S_1$ and $S_2$ to adhere temporarily to the belt 14 in the transport regions 14*a* and 14*b*, so that the sheets do not move or shift with respect to the belt, thereby assuring precise positioning of the sheets as they travel through the equipment.

The transport belt 14 is endless and is supported on a series of rollers 16. At least one roller, 16*a*, is driven by a variable speed drive motor 18. The belt 14 is also entrained on a roller 24*a* for driving an encoder 24. The encoder 24 can be a conventional optical or inductive encoder, but is preferably a design employing a laser read compact disc, as disclosed in copending Application Ser. No. 07/769,290 filed Oct. 1, 1991, assigned to the assignee of the present invention, the disclosure of which is incorporated herein by reference.

A printer 20 is disposed within the housing and can comprise a single full-width thermal ink jet printing bar 21*a* for printing black and white documents. If color printing is desired, the printer 20 includes additional printer bars, 21*b*, 21*c*, 21*d*, conventionally one for each of the three colors, cyan, magenta and yellow or red, green and blue. Downstream of the printer 20 is a dryer 26, preferably of a microwave type.

Recording media such as the sheets $S_1$ and $S_2$ are fed into the printing apparatus through a sheet inlet 28 onto the transport belt 14. The sheets are carried by the transfer belt 14 to the printer 20. The portion of the sheet directly beneath the print bars is supported by the plate 22. An arrangement that has been found to be particularly useful is to mount the encoder 24 beneath the plate 22, with the displaced portion of the belt disposed about the roller 24*a* of the encoder 24. In this arrangement, a space is created beneath the thermal ink jet bars for providing a maintenance station (not shown)

for the ink jet bars for maintaining them in operative condition. Such maintenance stations are known and no further detailed explanation thereof is believed necessary.

The encoder 24 provides signals indicative of the position of the belt, which are utilized to control operation of workstations, such as printer 20 and dryer 26 to compute the speed of the belt 14 and otherwise control operation of the printer.

The drive motor 18 drives at least one of the rollers 16, such as roller 16*a*, which in turn causes movement of the belt 14 on the rollers 16. At inlet 28, the sheets ($S_1$, $S_2$) are fed onto to the belt 14. The vacuum arrangement associated with the belt holds each sheet on the belt so that it does not move transversely or longitudinally with respect to the belt after being placed on it. The belt 14 carries the sheets to the printer station 20, where an image is formed by the jetted ink on the upwardly facing surface of the sheets. The length of the support plate 22 is shorter than the length of the sheet being fed so that a portion of the sheet is always adhered to the belt and moves with the belt. After passing the printer 20, the sheets are introduced into the dryer 26 and the water or other liquid component of the ink deposited on the paper is driven off as a vapor. Continued movement of the belt 14 drives the sheet to the outlet 30 for removal or subsequent handling. Thus, the inlet 28, the belt 14 and the outlet 30 define a feed path through the printing apparatus 10.

In general, the printing apparatus 10 is controlled so that the process speed is instantaneously variable in response to the density of the ink being jetted and/or dried. For low density imaging (approximately 6% to 20% density), motor 18 is driven at high speed. As the density increases, the speed of drive motor 18 is reduced correspondingly so that the power required by the printer and/or the power required by the dryer is maintained below a predetermined level. In this manner, it is possible to have each sheet travel through the printer at varying rates of speed depending upon the density of the printing in each area of the sheet.

Figure 2:
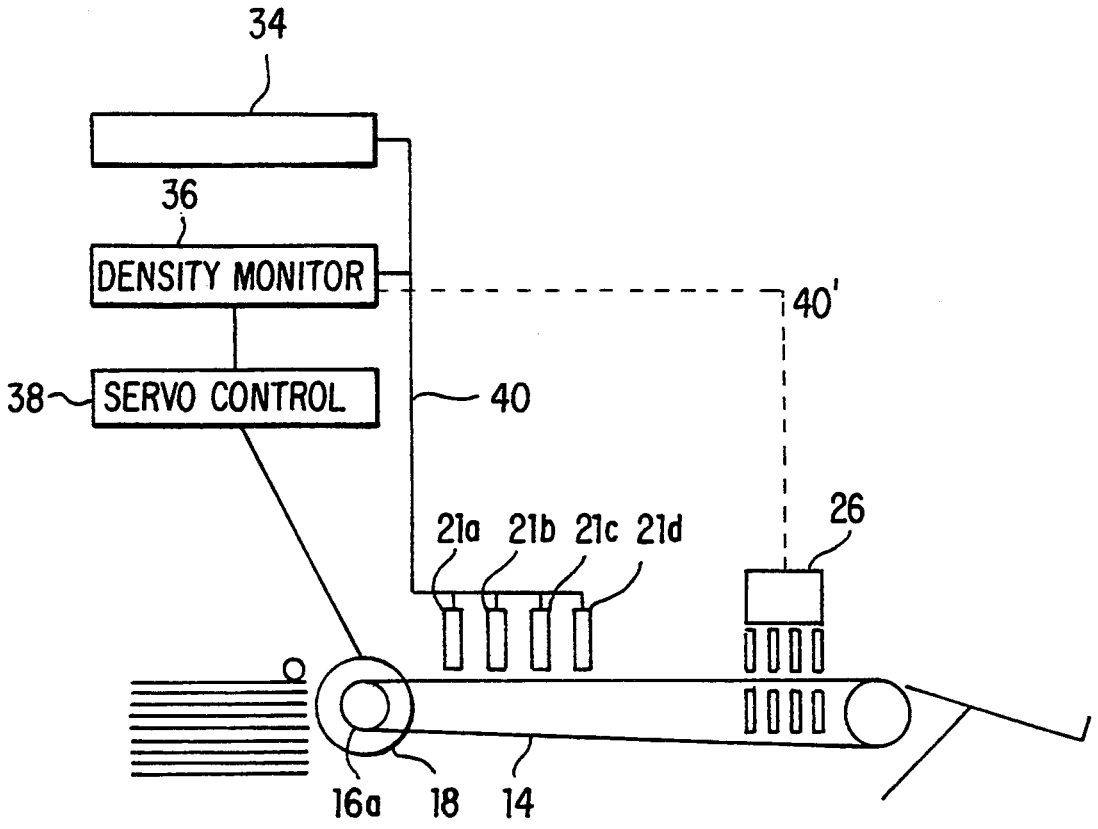
FIG. 2 is a schematic of a motor control system for the printer illustrated in FIG. 1.

FIG. 2 schematically shows one embodiment of a control system for the printing apparatus 10. A source of print data 34, such as a video source, provides printing data to the thermal ink jet printing bars 28*a*, 28*b*, 28*c* and 28*d* for controlling the formation of images on the recording medium. The data can be in the form of bitmap data and is conventionally supplied in raster fashion, on a line by line basis. In the embodiment shown, the density monitor 36 receives printing data from line 40 and, on the basis of raster pixel density, provides a signal to the servo-control 38 for setting the speed of drive motor 18. The density monitor 36 can comprise a stand alone microprocessor or be implemented in a microprocessor which controls the printer. From the printing data, the density monitor determines the appropriate timing for effecting speed changes according to the position of the recording medium on the vacuum transport belt 14. Appropriate speeds can be selected by the density monitor on the basis of values in a stored look-up table, which values are empirically determined for the printer. That is, the table correlates a range of density levels with a copy speed at each density level which maintains the power consumption of the print station 20 or the dryer 26 (or both) below a predetermined power level.

Alternately, the density monitor 36 can detect printhead current to develop speed control signals to supply to servo controller 36. The above-mentioned density determining arrangements can be implemented by routine programming techniques. Accordingly, no further details regarding the density monitor 36 are necessary.

As an alternative to monitoring the printing data, the microwave dryer 26 can be monitored to provide speed control information. Ideally, a microwave dryer, such as dryer 26, is operated at a fixed power output. A portion of this output couples with the ink to heat the ink and dry it. The amount of power in excess of that necessary to dry the ink is absorbed in a dummy load. In the dummy load, the excess microwave power is converted to heat, which is dissipated. The amount of power dissipated in the dummy load is directly related to the density of the ink on the recording medium and the speed at which the recording medium proceeds through the dryer. If very little power is absorbed in the dummy load, this is an indication that the dryer is operating close to optimum speed for the density of printing being dried. If the power dissipated in the dummy load is high, it is an indication that the amount of ink to be dried is low, resulting from the density and/or the speed of the recording medium being low. Under these conditions, the speed of the belt 14 can be increased so that more ink is brought into the drier per unit time. In FIG. 2, the dotted line 40' illustrates connection of the density monitor 36 to the microwave dryer 26 as an alternative control arrangement. Line 40' is provided with a signal representative of the power dissipated in the dummy load of the microwave dryer 26 and the density monitor 36 provides a control signal to servo-control 38 for controlling drive motor 18 so that the amount of power dissipated in the dummy load is minimized.

Because the density of the printing can be determined from printing data supplied to the printer or from power usage of the dryer, the control system can anticipate or determine the need for speed changes. Also, because the drying zone has a finite width in the process direction, this has the effect of integrating speed change effects. Varying the process speed controls the residence time of each sheet or portion thereof in the dryer 26. Thus, the dryer can operate in timed on/off mode, eliminating the need for a variable energy power supply and thereby reducing cost of the dryer unit.

In a typical design, using an 800 watt microwave dryer, image densities between 6% to 20% would require a drive speed yielding about 45 $8\frac{1}{2}\times 11''$ copies per minute, slow to 11 copies per minute for 100% highlight color and to 5 copies per minute for 230% process color, all at a peak power demand below 1.5 KVA. Copy rates can be increased by providing for white space acceleration, commonly in leading and trailing border edges of the sheets. That is, when an area of the recording medium which is to receive no printing is disposed at the printing station 20 or the dryer 26, as determined by the density monitor 36, the speed of the belt 14 is raised quickly so that the unprinted portion of the recording medium traverses the work stations quickly.

The preferred embodiments of the invention have been described herein, and are intended to be illustrative and not limiting. Various changes can be made in relation to the preferred embodiments without departing from the spirit and scope of the invention as defined in the appended claims.

What is claimed is:

1. A printing apparatus comprising:

means for depositing a dryable ink on a recording medium to form an image;

a microwave dryer having an energy absorbing means for absorbing microwave energy not consumed in drying ink, said energy absorbing means comprises a dummy load for dissipating excess microwave energy;

a conveying member for conveying the recording medium with an image formed thereon through the dryer;

determining means for determining the energy, consumed by the dryer to dry the ink on the recording medium, said determining means including means for sensing the amount of energy dissipated in the dummy load; and means for controlling the speed of the conveying member in accordance with the energy consumption determined by the determining means.

2. A printing apparatus comprising:

means for depositing a dryable ink on a recording medium to form an image;

a dryer having an energy absorbing means for absorbing energy not consumed in drying ink;

a conveying member for conveying the recording medium with an image formed thereon through the dryer;

determining means for determining the energy, consumed by the dryer to dry the ink on the recording medium, said determining means including means for sensing the amount of energy absorbed in the energy absorbing means; and means for controlling the speed of the conveying member in accordance with the energy consumption determined by the determining means.

* * * * *